United States Patent [19]
Osawa et al.
[11] 3,982,905
[45] Sept. 28, 1976

[54] POROUS VALVE SEAT MATERIALS FOR INTERNAL COMBUSTION ENGINES

[75] Inventors: Makoto Osawa, Tokyo; Yoshitoshi Hagiwara, Niiza; Takao Kawakita, Itami; Kenya Motoyoshi, Itami; Nobuhito Kuroishi, Itami, all of Japan

[73] Assignees: Honda Giken Kogyo Kabushiki Kaisha, Tokyo; Sumitomo Electric Industries, Ltd., Osaka, both of Japan

[22] Filed: Dec. 28, 1973

[21] Appl. No.: 429,300

[30] Foreign Application Priority Data

Jan. 11, 1973 Japan ..... 48-6185

[52] U.S. Cl. ..... 29/182.5; 29/182; 75/128 B; 75/128 D; 75/128 W; 75/128 R; 75/128 P

[51] Int. Cl.[2] ..... C22C 1/08; C22C 1/05; C22C 1/04

[58] Field of Search ..... 29/182, 182.5; 75/128 B, 128 D, 128 P, 128 W, 128 R

[56] References Cited

OTHER PUBLICATIONS

Chem. Abs. No. 80: 18173v, Ger. Offen., 2,314,729, 10/11/73, Honmu, V.

Chem. Abs. No. 80: 18165u, Japan Kokai, 73:60009, 8/23/73, Osawa et al.

*Primary Examiner*—Richard E. Schafer
*Attorney, Agent, or Firm*—Wenderoth, Lind & Ponack

[57] ABSTRACT

This invention relates to a valve seat material for an internal combustion engine, which comprises a sintered ferrous alloy having the composition:

| | |
|---|---|
| chromium | 5–15 percent by weight |
| cobalt | 5–20 |
| nickel | 2–8 |
| tungsten | 2–10 |
| molybdenum | 0.2–12 |
| carbon | 0.2–2 |

the remainder being iron except for usual impurities and trace elements, and having a porosity of 5–25%. This alloy can also contain lead and a low melting point glass capable of showing a lubricating property at a low temperature.

7 Claims, No Drawings

POROUS VALVE SEAT MATERIALS FOR INTERNAL COMBUSTION ENGINES

BRIEF SUMMARY OF THE INVENTION:

A valve seat material for an internal combustion engine should have the following properties:

1. Sufficient fatigue strength and creep strength for an impact load at a high temperature
2. Excellent wear resistance at a high temperature Up to the present time, ordinary cast irons, low alloy cast irons such as containing Cu-Cr-Mo and Ni-Cr-Mo and high chromium steels such as containing 12 % chromium and 2 % carbon, and 8 % chromium and 1 % carbon have been used as a valve seat material for an internal combustion engine. The valve seat is always exposed to a combustion gas in the operation of an internal combustion engine and subjected to not only a high temperature of from 300° to 700°C by the heat from the valve face, but also an impact load by the beating of valve and a sliding action by the irregular rotation of valve. In an internal combustion engine using the ordinary lead-containing gasoline, the lead contained in gasoline reacts with sulfur, phosphorus, calcium and sodium contained in oil or gasoline to form combustion products such as lead oxide, lead sulfate, calcium oxide, sodium oxide, phosphorus oxide and calcium sulfate, which may possibly form a film playing a role as an antioxidant or antifriction material between the contact surfaces of the valve and valve seat. In another internal combustion engine using a lead-free gasoline, on the contrary, such lubricating products are not formed and the valve and valve seat are brought into direct contact at a high temperature, resulting in rapid wearing of the valve seat and, sometimes, the valve itself due to adhesive wearing. Consequently, the engine cannot be operated normally, since there is no tappet clearance due to such abnormal wearing.

It is an object of the invention to provide an improved valve seat material for an internal combustion engine, which overcomes this difficulty and which is resistant to oxidation and wearing at high temperatures.

It is another object of the invention to provide a valve seat material for an internal combustion engine, which is suitable for use of lead-free gasolines.

Further objects of the invention will become apparent from the following description and embodiments.

We, the inventors, have made efforts to develop such valve seat material and have found that the composition as well as the porosity of a sintered ferrous alloy are very important for satisfying the severer specifications of an internal combustion engine.

DETAILED DESCRIPTION OF THE INVENTION

In accordance with the present invention, therefore, there is provided a valve seat material for an internal combustion engine, which comprises a sintered ferrous alloy having the composition: 5–15 % by weight chromium, 5–20 % cobalt, 2–8 % nickel, 2–10 % tungsten, 0.2–12 % molybdenum, 0.2–2 % carbon, optionally 0–10 % lead and 0–5 % glass and the remainder being iron except for usual impurities and trace elements, and having a porosity of 5–25%.

The above mentioned alloy has particular application to a valve seat insert for a reciprocating internal combustion engine and can be produced preferably by mixing the corresponding powders in the required proportions, pressing these to form a compact and sintering the compact.

The features of the alloy according to the invention are as follows:

1. The base matrix is a sintered ferrous alloy containing Cr, Co, Ni, W, Mo, C and Fe.
2. The matrix is subjected to heat and a mechanical strain, whereby compounds of Co-Cr, Co-Mo, and Co-W are precipitated and it is hardened.
3. The matrix is a sintered alloy having a porosity of 5–30 %.
4. In one preferred embodiment, lead and a low melting point glass, in combination, are incorporated in the alloy, which are capable of melting and forming a lubricating film on the surface of a valve seat. preferably lead is contained in a proportion of 0.3–10 % and glass in a proportion of 0.3–5 %.

In the above mentioned composition of the valve seat material according to the invention, chromium combines with carbon to form a tenacious carbide, thus raising the wear resistance of the matrix, and, at the same time, forms a tenacious oxide film during use to contribute to the corrosion resistance as well as a compound with cobalt followed by precipitation to thus raise the strength of the matrix at a high temperature. The chromium is added in a quantity of 5–15 %, since if less than 5 %, these effects are little and if more than 15 %, the workability lowers markedly, the brittleness increases and the function of forming an oxide lowers. Cobalt plays a role of raising the heat resistance of the matrix as well as precipitating work-induced modification compounds of Co-Cr, Co-Mo and Co-W to hold the wear resistance at a high temperature. The cobalt is added in a quantity of 5–20 %, since if less than 5 %, formation of these compounds is not sufficient and if more than 20 %, the effects are not increased considering for economy. Tungsten dissolves in iron and precipitates a compound of Co-W at a high temperature to raise the strength of ferrite at a high temperature, while tungsten combines with carbon to form a carbide like chromium, thus contributing to the wear resistance. The range of quantity of the tungsten to be added is limited to 2–10 %, since if less than 2 %, the strengthened extent is not sufficient and if more than 10 %, troublesome problems on the production take place and the toughness lowers. Nickel is effective in strengthening the ferrite as well as improving the toughness of the matrix. The nickel is added in a quantity of 2–8 %, since if less than 2 %, these effects are little and if more than 8 %, precipitation of carbides is markedly suppressed. Since manganese has the similar effects to nickel, a part or all of the nickel may be substituted by manganese. Molybdenum contributes to the improvement of the heat resistance of the matrix. Moreover, molybdenum dissolves in the ferrite to raise the creeping strength and combines partly with carbon to precipitate a carbide and partly with cobalt to precipitate a Co-Mo compound, thereby improving the wear resistance at a high temperature. The molybdenum is added preferably in a quantity of 0.2–8 %, since if less than 0.2 %, the effects are insufficient and if more than 8 %, the quality becomes brittle and the workability deteriorates markedly, However, where the quantity of chromium is less than about 10 %, the workability does not lower so much and, accordingly, molybdenum can be increased to about 12 %. Carbon combines with chromium, molybdenum and iron to form their carbides, thus improving the strength, heat resistance and wear resistance. The carbon is added in a quantity of 0.2–2 %, since if less than 0.2 %, the effects are little and if more than 2 %, the quality becomes brittle.

The one feature of the invention is to limit the porosity to 5–25 %. The feature of a sintered alloy consists originally in its porosity, but, in the case of using it as a heat resisting material which should have a high temperature strength, it is usual for those skilled in the art to assure the strength by raising the density as highly as possible. The reason of limiting the porosity to 5–25 % in the present invention, on the contrary, is as follows:

When using a lead-containing gasoline as mentioned hereinbefore, combustion residues consisting of lead sulfate, calcium sulfate, sodium sulfate and phosphorus oxide are formed between a valve and valve seat, which prevent the metal adhesion between the valve and valve seat at a high temperature. However, it is confirmed that even when using a lead-free gasoline, combustion residues consisting mainly of lead sulfate and phosphorus oxide are also formed to some extent, which play a role of preventing the metal adhesion between the valve and valve seat. Now it is taken into consideration to utilize the porosity of a sintered alloy as a method of allowing these combustion residues to exist between the valve and valve seat in effective manner. That is to say, the combustion residues, which are formed in the operation of an internal combustion engine, are softened by heat and buried in pores opened on the surface of the valve seat in mechanical manner by the working of the valve, whereby the combustion residues are held more firmly and the adhesion of metals between the valve and valve seat can be prevented, as compared with cases where, as in the ordinary melted materials or high density sintered materials, these combustion residues are liable to be removed. The porosity should preferably be within a range of 5 to 30 %, since if less than 5 %, the quantity of pores opened on the surface of a valve seat is too less to hold a sufficient quantity of the combustion residues and if more than 30 %, the sintered alloy loses the strength itself and is not able to resist a high temperature, although the quantity of the combustion residues held is increased.

In one preferred embodiment of the invention, lead and glass are incorporated in the alloy, preferably in a proportion of 0.3–10 % and 0.3–5 % respectively, as a lubricating material capable of softening, melting and thus forming a lubricating film on the surface of a valve seat. If the lead is used in a proportion of less 0.3 %, such effect is little and if more than 10 %, the strength of the sintered alloy lowers. Lead has an effect of preventing the adhesion of metal by its plasticity and wear resistance and thus is most suitable for use as a lubricating component. Since other low melting point metals such as indium, bismuth, antimony and tin have substantially the similar lubricating effect to lead, at least one of these metals can be used in place of a part or all of the lead. On the other hand, as such glass is preferably used a low melting point glass melting at a temperature of lower than 800°C, for example, containing lead oxide, zinc oxide, phosphorus oxide, boron oxide and lithium oxide. If the glass is used in a proportion of less than 0.3 %, the lubricating property at a high temperature is inadequate and if more than 5 %, the strength of the sintered alloy itself lowers. Lead gives well a lubricating property at a relatively low temperature range, whilst glass gives well it at a relatively high temperature range. Therefore, the use of lead and glass in combination results in better results, that is, more stabilized lubricating effect and wear resistance at a temperature ranging from room temperature to high temperatures.

The valve seat material comprising a sintered ferrous alloy according to the invention can be manufactured by the mass production system and is so excellent in fatigue strength, creeping strength, wear resistance and heat resistance at high temperatures that the severer requirements of an internal combustion engine can favourably be satisfied.

The following examples are to illustrate the invention in more detail without limiting the same.

EXAMPLES

The chemical compositions of the sintered alloys according to the invention and comparative alloys are shown in Table 1, and the results of their durability tests are shown in Table 2.

Steels A to C for comparison, having the following composition, were melted in a high frequency furnace of 7 kg, cast in a ring of 40 $\phi \times 20\ \phi \times 15$ mm and subjected to a certain heat treatment to give a predetermined hardness. In this heat treatment, Steel A was subjected to an oil quenching at 1000°C and tempering at 700°C and Steels B and C were subjected to an oil quenching at 1000°C only. Samples M to U were sintered alloys but given for comparison.

Sintered ferrous alloys D to $L_2$ of the invention were prepared by mixing the corresponding powders in the required proportions, pressing and sintering at 1250°C for 30 minutes to give alloys of the following compositions and to give a porosity of 5–30 % corresponding to a density of 95–70 %. The sintered alloys D to F were somewhat forged to a density of 95 % (porosity: 5 %). The so obtained samples were worked or finished in a predetermined size and then subjected to the following durability test:

Test of Durability

Using a 360 cc, water-cooling, two cylinder- and two carburetter-engine at 8000 rpm with full throttle and full load, the tappet gap was first adjusted to 0.1 m/m and a period of time was measured irrespective of the right and left cylinders when the gap became zero. The life of a ring for the valve seat was defined by the measured period of time. After this test, the microanalysis was carried out for the valve seat.

A gasoline was used having an octane number of 87 and containing lead in a quantity of 0.002 g/gallon.

Table 1

| Sample No. | Chemical composition (% by weight, remainder: Fe) | Dencity (%) | Hardness (mHV) |
|---|---|---|---|
| A | C 2.0, Cr 12.0, Mo 0.4 | 100 | 365 |
| B | C 1.5, Cr 20.0, Ni 10.0, P 0.2 | 100 | 340 |
| C | C 2.0, Cr 12.0, Ni 40.0, P 0.2, Mo 2.0 | 100 | 336 |
| D | C 1.0, Cr 10.0, Co 10, W 5, Ni 2, Mo 0.5 | 95 | 350 |
| E | C 1.5, Cr 6.0, Co 8.0, W 4.0, Ni 4.0, Mo 0.2 | 95 | 330 |
| F | C 1.0, Cr 15, Co 15, W 10, Ni 8, Mo 0.2 | 95 | 375 |
| $G_1$ | C 1.0, Cr 10.0, Co 10, W 5, Ni 2, Mo 0.5 | 70 | 350 |
| $H_1$ | " | 80 | 350 |
| $H_1'$ | C 0.2, Cr 5.0, Co 5.0, W 2.0, Ni 5.0, Mo 8.0 | 80 | 350 |
| $I_1$ | C 1.5, Cr 6.0, Co 8.0, W 4.0, Ni 4.0, Mo 0.2 | 70 | 330 |

Table 1-continued

| Sample No. | Chemical composition (% by weight, remainder: Fe) | Dencity (%) | Hardness (mHV) |
|---|---|---|---|
| $J_1$ | " | 80 | 335 |
| $J_1'$ | C 2.0, Cr 5.0, Co 20.0, W 4.0, Ni 5.0, Mo 5.0 | 80 | 335 |
| $J_2$ | C 1.5, Cr 6.0, Co 8.0, W 4.0, Ni 4.0, Mo 10.0 | 70 | 341 |
| $J_3$ | " | 80 | 355 |
| $K_1$ | C 1.0, Cr 15, Co 15, W 10, Ni 8, Mo 2 | 70 | 375 |
| $L_1$ | " | 80 | 369 |
| $G_2$ | C 1.0, Cr 10.0, Co 10, W 5, Ni 2, Mo 0.5, Pb 3.0, G 2.0 | 70 | 348 |
| $G_3$ | C 1.0, Cr 10.0, Co 10, W 5, Ni 2, Mo 0.5, Pb 0.3, G 0.3 | 80 | 348 |
| $G_4$ | C 1.0, Cr 10.0, Co 10, W 5, Ni 2, Mo 0.5, Pb 10.0, G 5.0 | 80 | 348 |
| $H_2$ | C 1.0, Cr 10.0, Co 10, W 5, Ni 2, Mo 0.5, Pb 3.0, G 2.0 | 80 | 350 |
| $I_2$ | C 1.5, Cr 6.0, Co 8.0, W 4.0, Ni 4.0, Mo 0.2, Pb 3.0, G 2.0 | 70 | 335 |
| $J_4$ | C 1.5, Cr 6.0, Co 8.0, W 4.0, Ni 4.0, Mo 0.2, Pb 3.0, G 2.0 | 80 | 335 |
| $J_5$ | C 1.5, Cr 6.0, Co 8.0, W 4.0, Ni 4.0, Mo 10.0, Pb 3.0, G 2.0 | 70 | 352 |
| $J_6$ | " | 80 | 352 |
| $K_2$ | C 1.0, Cr 15, Co 15, W 10, Ni 8, Mo 2, Pb 3.0, G 2.0 | 70 | 370 |
| $L_2$ | " | 80 | 369 |
| M | C 2.0, Cr 12.0, Mo 0.4 | 80 | 365 |
| N | C 1.3, Cr 20, Ni 10, P 0.2 | 80 | 340 |
| O | C 1.8, Cr 12.0, Ni 40.0, P 0.2, Mo 2.0 | 80 | 336 |
| P | C 1.0, Cr 10.0, Co 10, W 5, Ni 2, Mo 0.5 | 99 | 348 |
| Q | C 1.5, Cr 6.0, Co 8.0, W 4.0, Ni 4.0, Mo 0.2 | 99 | 332 |
| R | C 1.0, Cr 10.0, Co 10.0, W 5.0, Ni 2.0, Mo 0.5 | 99 | 369 |
| S | C 2.0, Cr 12.0, Mo 0.4 | 99 | 355 |
| T | C 1.5, Cr 20.0, Ni 10.0, P 0.2 | 99 | 355 |
| U | C 2.0, Cr 12.0, Ni 40.0, P 0.2, Mo 2.0 | 99 | 355 |

Table 1-continued

Note: G = glass

Table 2

(After Durability Test)

| | Density Change | | Hardness | | Durability | |
|---|---|---|---|---|---|---|
| | Density | Change Quantity | Near Butted Surface | Inside | Time | hrs |
| A | 100 % | 0 | 319 mHV | 368 mHV | 6 | 3 |
| B | 100 | 0 | 351 | 376 | 37 | 42 |
| C | 100 | 0 | 370 | 372 | 64 | 61 |
| D | 97 | +1 % | 495 | 345 | 98 | 86 |
| E | 97.5 | +1.5 | 462 | 328 | 82 | 84 |
| F | 97 | +1 | 501 | 358 | 111 | 86 |
| $G_1$ | 75 | +5 | 508 | 351 | 165 | 118 |
| $H_1$ | 84 | +4 | 492 | 356 | 148 | 196 |
| $H_1'$ | 84 | +4 | 462 | 352 | 125 | 136 |
| $I_1$ | 74 | +4 | 459 | 331 | 109 | 118 |
| $J_1$ | 83 | +3 | 470 | 328 | 111 | 136 |
| $J_1'$ | 83 | +3 | 458 | 325 | 141 | 129 |
| $J_2$ | 74 | +4 | 525 | 345 | 165 | 138 |
| $J_3$ | 83 | +3 | 512 | 348 | 151 | 146 |
| $K_1$ | 75 | +5 | 496 | 361 | 185 | 136 |
| $L_1$ | 84 | +4 | 515 | 359 | 176 | 185 |
| $G_2$ | 76 | +6 | 485 | 355 | 154 | 176 |
| $G_3$ | 86 | +6 | 485 | 355 | 152 | 140 |
| $G_4$ | 86 | +6 | 485 | 355 | 146 | 162 |
| $H_2$ | 86 | +6 | 470 | 349 | 170 | 198 |
| $I_2$ | 75 | +5 | 459 | 328 | 129 | 151 |
| $J_4$ | 85 | +5 | 456 | 332 | 130 | 137 |
| $J_5$ | 74 | +4 | 511 | 389 | 200 | 190 |
| $J_6$ | 84 | +4 | 509 | 400 | 189 | 192 |
| $K_2$ | 75 | +5 | 475 | 358 | 200 | 176 |
| $L_2$ | 86 | +6 | 491 | 361 | 218 | 236 |
| M | 86 | +6 | 311 | 362 | 15 | 28 |
| N | 85 | +5 | 350 | 361 | 41 | 38 |
| O | 84 | +4 | 352 | 369 | 64 | 69 |
| P | 99.5 | +0.5 | 486 | 336 | 78 | 72 |
| Q | 100 | +1 | 470 | 339 | 83 | 78 |
| R | 99 | 0 | 496 | 356 | 85 | 87 |
| S | 99 | 0 | 326 | 365 | 4 | 8 |
| T | 99 | 0 | 341 | 375 | 32 | 43 |
| U | 99 | 0 | 368 | 381 | 60 | 71 |

As evident from the results of Examples and Comparative Examples, the sintered ferrous alloys having the composition and porosity according to the present invention can favourably be compared in durability with the high chromium cast steels and high density heat resistant sintered steels, which have commonly been used for lead-containing gasolines. This is possibly due to that the alloy of the composition according to the invention precipitates compounds of Co-Cr, Co-Mo and Co-W and hardens under such a condition that a suitable atmosphere, heat and mechanical strain are given. That is to say, the first factor of the advantage that the sintered alloy of the invention is more excellent in durability consists in that when it is used as a valve seat, it is exposed to an oxidizing combustion atmosphere at 300°–600°C, subjected to a mechanical compression and sliding strain by the working of the valve and the hardness thereof increases remarkably, whereas the ordinary material shows rather a tendency of softening near the surface of the valve seat in contact with the valve. The second factor is that the alloy of the invention has a porosity of 5–30 % and, preferably, contains lead and glass. When it is exposed to an oxidizing atmosphere at a high temperature in the operation of an internal combustion engine, a wear resistance oxide film is formed on the surface to thus prevent the metallic adhesion of the valve and valve seat and a glass-like combustion residue consisting mainly of calcium sulfate, phosphorus oxide and sodium oxide is firmly held in the pores. The surface oxide film and combustion residue are reacted at a temperature of 300°–600°C and vitrified to prevent the metallic adhesion of the valve and valve seat. As shown clearly in Examples, this can be proved by the fact that the alloy of the invention having a porosity of 5–30 % shows an increase of density by 4–5 % after the test, which is considered to be due to the oxidation increase by exposure to an oxidizing combustion atmosphere as well as the density increase by filling the pores with the combustion residues.

As shown in Comparative Examples, the alloys having either the similar composition or the similar porosity only to that of the invention cannot accomplish the objects of the invention. For the purpose of accomplishing the required objects, both the composition and porosity must be specified according to the present invention.

In the practice of the invention, for example, copper may be added to raise the thermal conductivity and, furthermore, other additives and impurities may be added for other objects without departing from the objects or effects of the invention. For example, alumium and titanium may be added for the purpose of the precipitation hardening, and trace amounts of selenium, tellurium and sulfur, for the purpose of improving the cutting property.

What is claimed is:

1. A valve seat material for an internal combustion engine, which comprises a sintered ferrous alloy having the composition:

| | percent by weight |
|---|---|
| chromium | 5–15 |
| cobalt | 5–20 |
| nickel | 2–8 |
| tungsten | 2–10 |
| molybdenum | 0.2–12 |
| carbon | 0.2–2 |

the remainder being iron except for usual

-continued

| | percent by weight |
|---|---|
| impurities and trace elements, | |

and having a porosity of 5–25 %.

2. The valve seat material for an internal combustion engine according to claim 1, wherein said sintered ferrous alloy comprises in addition lead and a low melting point glass.

3. A valve seat material for an internal combustion engine, which comprises a sintered ferrous alloy having the composition:

| | percent by weight |
|---|---|
| chromium | 5–15 |
| cobalt | 5–20 |
| nickel | 2–8 |
| tungsten | 2–10 |
| molybdenum | 0.2–12 |
| carbon | 0.2–2 |
| lead | 0.3–10 |
| glass | 0.3–5 |

the remainder being iron except for usual impurities and trace elements, and having a porosity of 5–25 %.

4. The valve seat material for an internal combustion engine according to claim 1, wherein a part or all of the nickel is substituted by 2–8 % by weight of manganese.

5. The valve seat material for an internal combustion engine according to claim 1, wherein said sintered ferrous alloy comprises in addition at least one of the substances selected from the group consisting of copper, aluminum and titanium.

6. The valve seat material for an internal combustion engine according to claim 3, wherein a part or all of the nickel is substituted by 2–8% by weight of manganese.

7. The valve seat material for an internal combustion engine according to claim 3, wherein said sintered ferrous alloy comprises in addition at least one of the substances selected from the group consisting of copper, aluminum and titanium.

* * * * *